US005258813A

United States Patent [19]

Nakahara et al.

[11] Patent Number: 5,258,813

[45] Date of Patent: Nov. 2, 1993

[54] DEVELOPING DEVICE FOR A MULTICOLOR IMAGE FORMING APPARATUS HAVING A TONER PARTICLE SIZE DISTRIBUTION WHICH PREVENTS MIXTURE OF TONERS OF DIFFERENT COLORS

[75] Inventors: Tomotoshi Nakahara, Yokohama; Hisao Murayama, Kawasaki, both of Japan

[73] Assignee: Ricoh Company, Ltd., Tokyo, Japan

[21] Appl. No.: 918,028

[22] Filed: Jul. 24, 1992

[30] Foreign Application Priority Data

Jul. 25, 1991 [JP] Japan ..... 3-186504

[51] Int. Cl.[5] ..... G03G 15/01; G03G 15/08

[52] U.S. Cl. ..... 355/245; 355/326 R

[58] Field of Search ..... 355/245, 326; 118/645, 118/653

[56] References Cited

U.S. PATENT DOCUMENTS 5,030,996 7/1991 Tajima et al. ..... 355/326 X
5,083,164 1/1992 Kamath et al. ..... 355/245

FOREIGN PATENT DOCUMENTS 56-142540 11/1981 Japan ..... 355/245
3-123361 5/1991 Japan ..... 355/245

*Primary Examiner*—Fred L. Braun
*Attorney, Agent, or Firm*—Oblon, Spivak, McClelland, Maier & Neustadt

[57] ABSTRACT

A developing device incorporated in a multicolor image forming apparatus for developing electrostatic latent images sequentially formed on a single image carrier by powdery toners of different colors stored in respective developing units which are arranged around the image carrier. The average particle size of toner sequentially increases from one of the developing units located at the most upstream side with respect to the moving direction of the image carrier toward the developing unit located at the most downstream side.

4 Claims, 3 Drawing Sheets

DEVELOPING DEVICE FOR A MULTICOLOR IMAGE FORMING APPARATUS HAVING A TONER PARTICLE SIZE DISTRIBUTION WHICH PREVENTS MIXTURE OF TONERS OF DIFFERENT COLORS

BACKGROUND OF THE INVENTION

The present invention relates to a developing device for a multicolor image forming apparatus.

An electronic color copier and a digital color copier, for example, belong to a family of multicolor image forming apparatuses which sequentially form electrostatic latent images on a single image carrier and develop the latent images one after another by toners of different colors to produce a multicolor image. The word "multicolor image" covers a broad range of images, i.e., a full-color image to a bicolor image. Generally, a developing device incorporated in such an image forming apparatus has a plurality of developing units each storing a toner of particular color and sequentially arranged around the image carrier. The problem with the multicolor image forming apparatus is the mixture of colors ascribable to toners flying about. Let this problem be discussed taking a red toner and a black toner as an example. When a black toner develops a latent image, it is partly scattered around in the image forming apparatus to contaminate the interior of the apparatus. Part of the black toner scattered around enters a developing unit storing a red toner and is, therefore, mixed with the red toner. As the amount of black toner mixed with the red toner increases, the resulting red image is impure and appears brownish. This critically degrades the quality of the bicolor image.

In the light of the above, a brush for preventing a toner from flying about may be located at the inlet side and the outlet side of each developing unit, as proposed in the past. Here, the inlet side and the outlet side refer respectively to the side where a latent image formed on the image carrier arrives at the developing unit and the side where it leaves the developing unit. The tip of each brush is held in contact with the surface of the image carrier except for the range where the image area of the image carrier moves. Although the brushes successfully prevent the toner from flying about in the non-image area, it cannot do so in the image area. Moreover, the length of the bristles of each brush have to be sequentially increased in the intended direction of movement of the image carrier, increasing the production cost of the developing units and confusing the assembly of the device.

When a plurality of developing units constituting a multicolor developing device are arranged one above another, the mixture of colors is more conspicuous in a lower developing unit than an upper developing unit. This will be readily understood from the fact that the scattered toner falls due to gravity. It will also be seen that as the periphery of the image carrier moves, the mixture of colors is more aggravated in a downstream developing unit with respect to the moving direction of the image carrier since the image carrier generates a stream of air in the moving direction. Usually, the toner is adhered to a carrier by electrostatic attraction. As the electrostatic force exerted by the latent image at the developing station overcomes the electrostatic attraction, the toner is transferred to the image carrier to develop the latent image. Toner particles deposited on the carrier by a weak force, i.e., carrying a small charge are scattered around. The amount of charge differs from one toner particles to another and generally increases with the decrease in particle size. Therefore, considering the entire toner, the amount of charge increases with the decrease in average particle size.

Assume that the average particle size of toner is sequentially increased from an upstream developing unit toward a downstream developing unit with respect to the moving direction of the image carrier or from an upper developing unit toward a lower developing unit. Then, the amount of charge of toner sequentially decreases from the upstream or upper developing unit toward the downstream or lower developing unit. The toner particles flown out of the upstream or upper developing unit carry smaller charges than the other particles in the same unit. However, once introduced into the downstream or lower developing unit, the charges of such toner particles are great relative to those of the toner particles existing in the unit, causing them to strongly adhere to the carrier.

In the event of development, the toner particles weakly adhered to the carrier are consumed first. Since the toner particles introduced in the downstream or lower developing unit have the adhesion thereof to the carrier increased relative to the toner particles originally existing therein, they are consumed little in the unit. It follows that although the toner particles scattered around from the upstream or upper developing unit may enter the downstream or lower developing unit, the mixture of toners is effectively reduced when it comes to the resulting toner image.

The amount of charge tends to decrease with the increase in the particle size of toner, as stated earlier. Hence, the charge distribution of toner resembles the particle size distribution of toner. Specifically, when the particle size distribution has a broader skirt, so does the charge distribution; the amount of toner particles carrying small charges and, therefore, apt to fly about increases. By loading all the developing units with toners having the same particle size distribution and the same ratio of the volumetric average particle size to number average particle size, it is possible to reduce the toner particles whose adhesion to the carrier is weak and, therefore, the amount of toner to fly about.

Considering resolution, for example, the reproducibility of a toner image increases with the decrease in the particle size of toner. In this sense, if the average particle size of toner which differs from one developing unit to another is confined in a certain range, the toner images formed by the respective toners will not appear different in quality at least to the eyes.

The present invention is based on the above considerations.

SUMMARY OF THE INVENTION

It is therefore an object of the present invention to provide a new and useful developing device for a multicolor image forming apparatus which substantially eliminates the mixture of colors without resorting to developing units having a special structure.

In accordance with the present invention, a developing device incorporated in a multicolor image forming apparatus for developing electrostatic latent images sequentially formed on a single image carrier by powdery toners of different colors by a dry process to thereby produce a multicolor toner image, the developing device comprises a plurality of developing units each storing respective one of the powdery toners and sequentially arranged around the periphery of the image carrier. The powdery toner stored in any one of the plurality of developing units has a greater average particle size than the developing unit located at the immediately upstream side with respect to an intended direction of movement of the image carrier.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
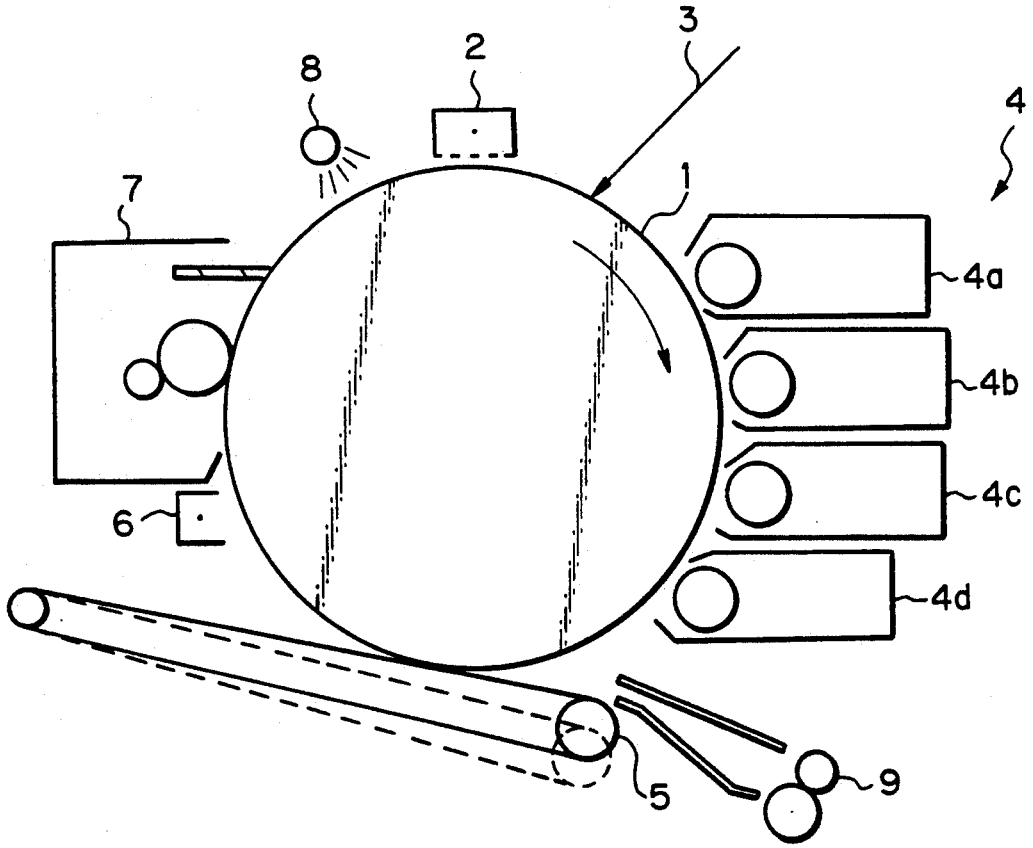
FIG. 1 is a section showing a digital copier to which a developing device embodying the present invention is applied.

Referring to FIG. 1 of the drawings, a digital multicolor copier to which a developing device embodying the present invention is applied is shown. As shown, the copier has a photoconductive element in the form of a drum 1 which is rotatable in a direction indicated by an arrow in the figure. A main charger 2 uniformly charges the surface of the drum 1 being rotated. A conventional scanner, not shown, reads a color document, not shown, while separating colors of the document. Conventional writing optics, not shown, writes images of separated colors on the drum 1 by a light beam 3. Specifically, an image to be developed by a yellow toner is written on the drum 1 first. The resulting electrostatic latent image is developed by a developing unit 4*a* storing a yellow toner Y therein. The development is reversal development using a dry process. The yellow toner image formed on the drum 1 is transferred to a transfer belt 5 by a transfer charger, not shown. At this instant, the transfer belt 5 is held in contact with the drum 1, as indicated by a solid line in the figure. After the image transfer, a precleaning discharger 6 dissipates the charge deposited on the drum 1. Subsequently, a cleaning device 7 removes the toner, i.e., yellow toner remaining on the drum 1. Further,a discharge lamp 8 discharges the drum 1 by light. Then, the main charger 2 again uniformly charges the surface of the drum 1.

Thereafter, an image to be developed by a magenta toner is written on the drum to form a corresponding electrostatic latent image. A developing unit 4*b* develops the latent image by a magenta toner M. The resulting magenta toner image is transferred to the transfer belt 5. By the same procedure, a latent image representative of an image to be developed by a cyan toner is formed on the drum 1 and developed by a cyan toner C stored in a developing unit 4*c*, and then a latent image representative of an image to be developed by a black toner is formed on the drum 1 and developed by a black toner BL stored in a developing unit 4*d*.

As the cyan toner image and the black toner image are sequentially transferred to the transfer belt 5, a multicolor toner image is formed on the belt 5. Then, the transfer belt 5 is moved away from the drum 1 to a position indicated by a phantom line in FIG. 1. In this condition, a paper sheet or similar recording medium, not shown, is fed by a register roller pair 9 and laid on the multicolor toner image existing on the transfer belt 5. The transfer charger, not shown, transfers the multicolor toner image to the paper sheet. The paper sheet with the toner image has the toner image fixed by a fixing device, not shown, and then driven out of the copier as a multicolor copy.

Figure 2:
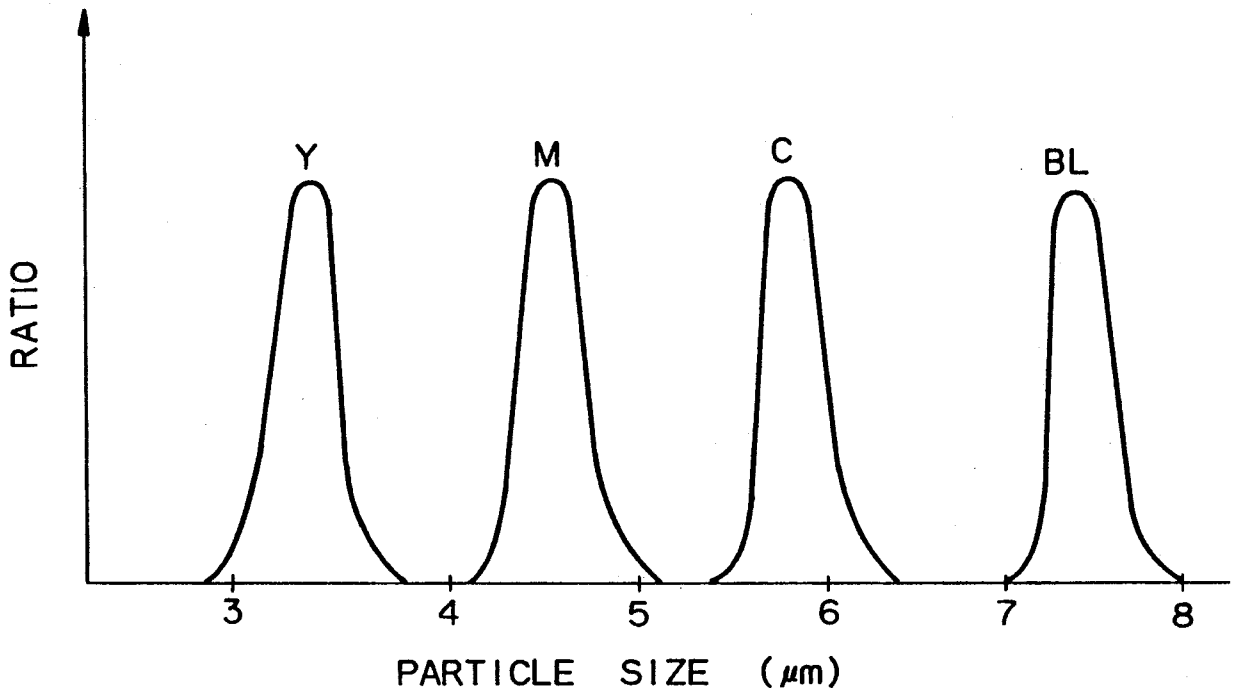
FIG. 2 is a graph indicative of a relationship between the particle size distributions and the average particle sizes of toners of different colors.

The developing units 4*a*–4*d* constitute a multicolor developing device 4 embodying the present invention. The yellow toner Y, magenta toner M, cyan toner C and black toner BL are each produced by dispersion polymerization and provided with a particle size distribution of 1.07 in terms of the ratio of volumetric average particle size to number average particle size. The average particle size sequentialy increases from the yellow toner Y to the black toner BL via the magenta toner M and cyan toner C. FIG. 2 is a graph showing the particle size distribution and average particle size (peak of particle size distribution) of each toner.

The developing units 4*a*–4*d* storing the respective toners in a predetermined amount were operated over a long period of time to effect the iterative multicolor image forming process so as to evaluate the resulting multicolor toner images. The toner images were free from noticeable mixture of colors and had desirable quality without regard to the kind of toner.

The above-mentioned dispersion polymerization refers to the following procedure. A high molecular dispersant is dissolved in a hydrophilic organic solvent. One or more vinyl monomers of the kind dissolving in the hydrophilic organic solvent and producing a polymer which is to be swelled by or hardly dissolved in such a solvent are added to the solvent. As a result, resinous particles (referred to as particles A hereinafter) are formed by polymerization. The particles A are dispersed in an organic solvent which does not dissolve the particles A. Before or after the dispersion, a dye is dissolved in the organic solvent to infiltrate the particles A. Thereafter, the organic solvent is removed to produce a toner. An experimental procedure consisted in using 320 grams of methanol as the hydrophilic organic solvent, dissolving 6.4 grams of polyvinylpyrolidone in the solvent as the high polymer dispersant, adding 25.6 grams of styrene, 6.4 grams of n-butylmethacrylate, and 0.2 gram of 2-2'-azobisisobutylonitryl as the vinyl monomers. As a result, styrene/n-butylmetacrylate copolymer particles were produced as the particles A. The particles A were infiltrated with a dye, and then a polarity control agent was added to the particles A to produce a toner.

Figure 3:
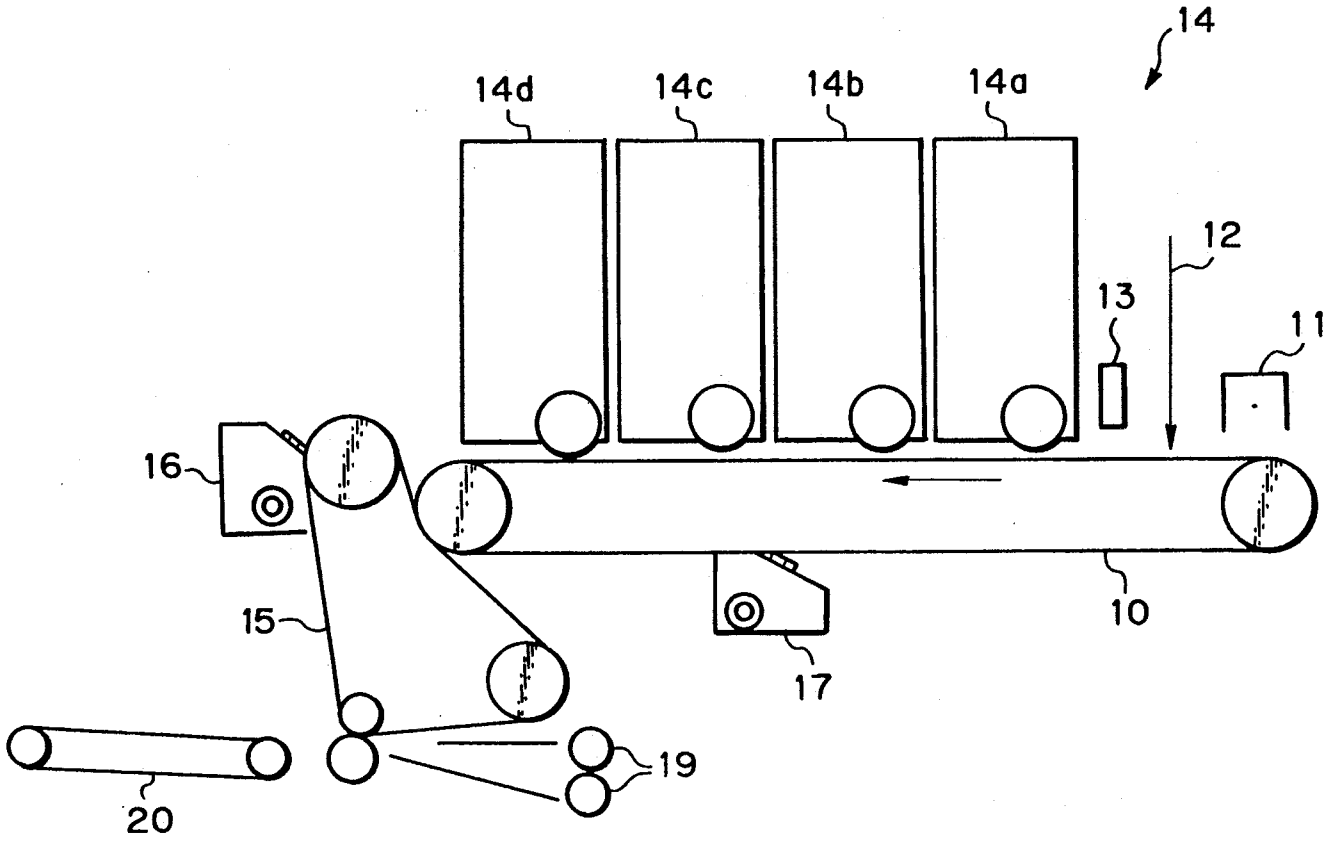
FIG. 3 is a section representative of an alternative embodiment of the present invention.

Referring to FIG. 3, a copier with which an alternative embodiment of the present invention is practicable is shown. As shown, the copier has a photoconductive element implemented as a belt 10 which is rotatable in a direction indicated by an arrow in the figure. While a main charger 11 uniformly charges the surface of the belt 10, a latent image is formed on the charged surface of the belt 10 by a light beam 12. An eraser 13 dissipates the charge from the non-image area of the belt 1. A multicolor developing device 14 has developing units 14*a*, 14*b*, 14*c* and 14*d* storing a yellow toner Y, magenta toner M, cyan toner C, and a black toner BL, respectively. There are also shown in the figure a transfer belt 15, cleaning devices 16 and 17, a register roller pair 19, and a belt 20 for transporting a paper sheet, not shown, carrying a multicolor image thereon to a fixing station, not shown. Electrostatic latent images each being representative of a particular color component are sequentially formed on the belt 10 and developed by the associated toners Y, M, C and BL. The resulting toner images are sequentially transferred to the transfer belt 15 to form a multicolor toner image. The multicolor toner image is transferred to a paper sheet, not shown.

In this embodiment, the toners Y, M, C and BL are also provided with the previously stated particle size distributions and average particle sizes. Therefore, the average particle size sequentially increases from the upstream developing unit 14*a* with respect to the moving direction of the belt 10 toward the downstream developing unit 14*d*.

In summary, it will be seen that the present invention provides a developing device which is substantially free from the mixture of toners of different colors despite that the toners fly about.

Various modifications will become possible for those skilled in the art after receiving the teachings of the present disclosure without departing from the scope thereof. For example, while the embodiments have been shown and described in relation to a digital multicolor copier, the present invention is, of course, practicable with a color copier, bicolor copier, etc.

What is claimed is:

1. A developing device incorporated in a multicolor image forming apparatus for developing electrostatic latent images sequentially formed on a single image carrier by powdery toners of different colors by a dry process to thereby produce a multicolor toner image, said developing device comprising:

a plurality of developing units each storing one of said powdery toners and sequentially arranged around the periphery of said image carrier, an average particle size of the powdery toner in each of said plurality of developing units sequentially increasing from a most upstream developing unit with respect to an intended direction of movement of said image carrier to a most downstream developing unit with respect to said direction of movement.

2. A developing device as claimed in claim 1, wherein all the toners stored in said plurality of developing units have the same particle size distribution which satisfies a condition:

$$\text{volumetric average particle size/number average particle size} \leqq 1.2.$$

3. A developing device as claimed in claim 2, wherein the toners are each produced by dispersion polymerization.

4. A developing device as claimed in claim 2, wherein the average particle size sequentially increases from the most upstream developing device to the most downstream developing device of said plurality of developing units within a range of 3–8 $\mu$m.

* * * * *